United States Patent [19]

Chiang et al.

[11] Patent Number: 4,960,223

[45] Date of Patent: Oct. 2, 1990

[54] BOX CRATE CONTAINER

[76] Inventors: Pei-Lieh Chiang; Ming-yao Chiang, both of Pei Tun Road, Taichung, Taiwan

[21] Appl. No.: 381,210

[22] Filed: Jul. 18, 1989

[51] Int. Cl.[5] ..... B65D 88/52

[52] U.S. Cl. ..... 220/7; 220/6

[58] Field of Search ..... 220/4 F, 6, 7

[56] References Cited

U.S. PATENT DOCUMENTS

| | | | |
|---|---|---|---|
| 3,858,745 | 1/1975 | Cloyd | 220/7 |
| 4,062,467 | 12/1977 | Friedrich | 220/7 |
| 4,591,065 | 5/1986 | Foy | 220/7 |
| 4,674,647 | 6/1987 | Gyenge et al. | 220/6 |
| 4,775,068 | 10/1988 | Reiland et al. | 220/6 |

FOREIGN PATENT DOCUMENTS

| | | | |
|---|---|---|---|
| 0541730 | 1/1977 | U.S.S.R. | 220/4 F |

*Primary Examiner*—Jimmy G. Foster

[57] ABSTRACT

An improved box crate container comprises a base plate, two handle plates and two side plates. The handle and side plates pivot inwardly to collapse to the container by means of two release bars which are respectively located within two "T" shaped slots of the side plates. The two "T" shaped slots are respectively located on the upper corners of the side plates. With the side and handle plates upright, adjacent edges of the side and handle plates interlock by means of "T" shaped slots and hooked snap-fitting locking tabs which are formed respectively on the upper corners of the handle plates. The base, side and handle plates may be formed by single piece plastic injection molded. The side and handle plates are pivotally connected to the base plate by means of connecting blocks with two snap-fitting pivot axes and swivel recesses with two pivot tabs. The connecting blocks with the two snap-fitting pivot axes are formed on the lower portion of the side and handle plates. The swivel recesses with the two pivot tabs are formed on the periphery of the base plate. Every two pivot tabs are respectively located on the either side of each swivel recess. A pivot hole is formed on each pivot tab and passed through by the snap-fitting pivot axes.

1 Claim, 6 Drawing Sheets

BOX CRATE CONTAINER

BACKGROUND OF THE PRESENT INVENTION

The present invention relates to an improved collapsible container. Accordingly, conventional containers occupy too much room when they are not used. Most of collapsible boxes or containers are usually composed of some little parts. And this not only causes users' inconvenience but also more monies than they should pay for, since conventionally the collapsible container does not work if only one or two little parts are lost.

Considering today's tooling, dies and product line for manufacturing box containers, we think the prior arts not only have more steps on the flow chart, but also raise the cost of the product. Then naturally, the cost burden would be transferred to the customers. In other words, it is somewhat unfair for the customers to pay the higher expense.

OBJECTS AND ADVANTAGES OF THE PRESENT INVENTION

The inventors have considered the above-mentioned troubles that users complained about; therefore, the present invention here is proffered to overcome the disadvantages of the prior arts or conventional boxes. The objects and advantages are enumerated as follows:

1. The primary characteristics of the present invention is that only five major pieces of plates which connected together by snapping fit, and of course there is no part except these five pieces of plates themselves, because each of them is made of single piece plastic injection molded.
2. The unlocking way of the improved box crate container is not only unique but also nearly impossible to be damaged, since release bars are designedly set at these locations, please refer to FIG. 6.

SUMMARY OF THE PRESENT INVENTION

The present invention relates to an improved box crate container. The improved box crate container comprises a base plate, a pair of side plates and a pair of handle plates.

A plurality of swivel recesses are formed on the periphery of the base plate. Each of them has a pair of pivot tabs respectively formed on its both sides. A pivot hole is respectively formed set on each of the pivot tabs. Each side plate has two "T" shaped slots formed respectively on its upper corners. A release bar is formed within each of the "T" shaped slots. A plurality of "L" shaped protruding catches are respectively formed on the periphery of the side plates, under the "T" shaped slot. And these devices allow the side plates to be connected with the handle plates. A plurality of connecting blocks, corresponding to each swivel recess of the base plate, are respectively formed on the lower periphery of the side plates; and each of them has a pair of snap-fitting pivot axes formed on its either side to pass through the pivot holes and connect with the base plate.

Corresponding to the "T" shaped slots and "L" shaped protruding catches of the side plates, each handle plate respectively has two hooked snap-fitting locking tabs formed on its upper corners and a plurality of rectangular slots on its periphery, under the hooked snap-fitting locking tab. Also each handle plate, corresponding to each swivel recess of the base plate, has a plurality of connecting blocks formed on its lower portion, then again each of them has a pair of snap-fitting pivot axes formed on its either side to pass through the pivot holes and connect with the base plate.

Please be aware that the base plate, the side plates and the handle plates separate into five pieces, and each of them is of single-piece plastic injection construction.

BRIEF DESCRIPTION OF THE PRESENT INVENTION

DESCRIPTION OF THE PREFERRED EMBODIMENT

Figure 1:
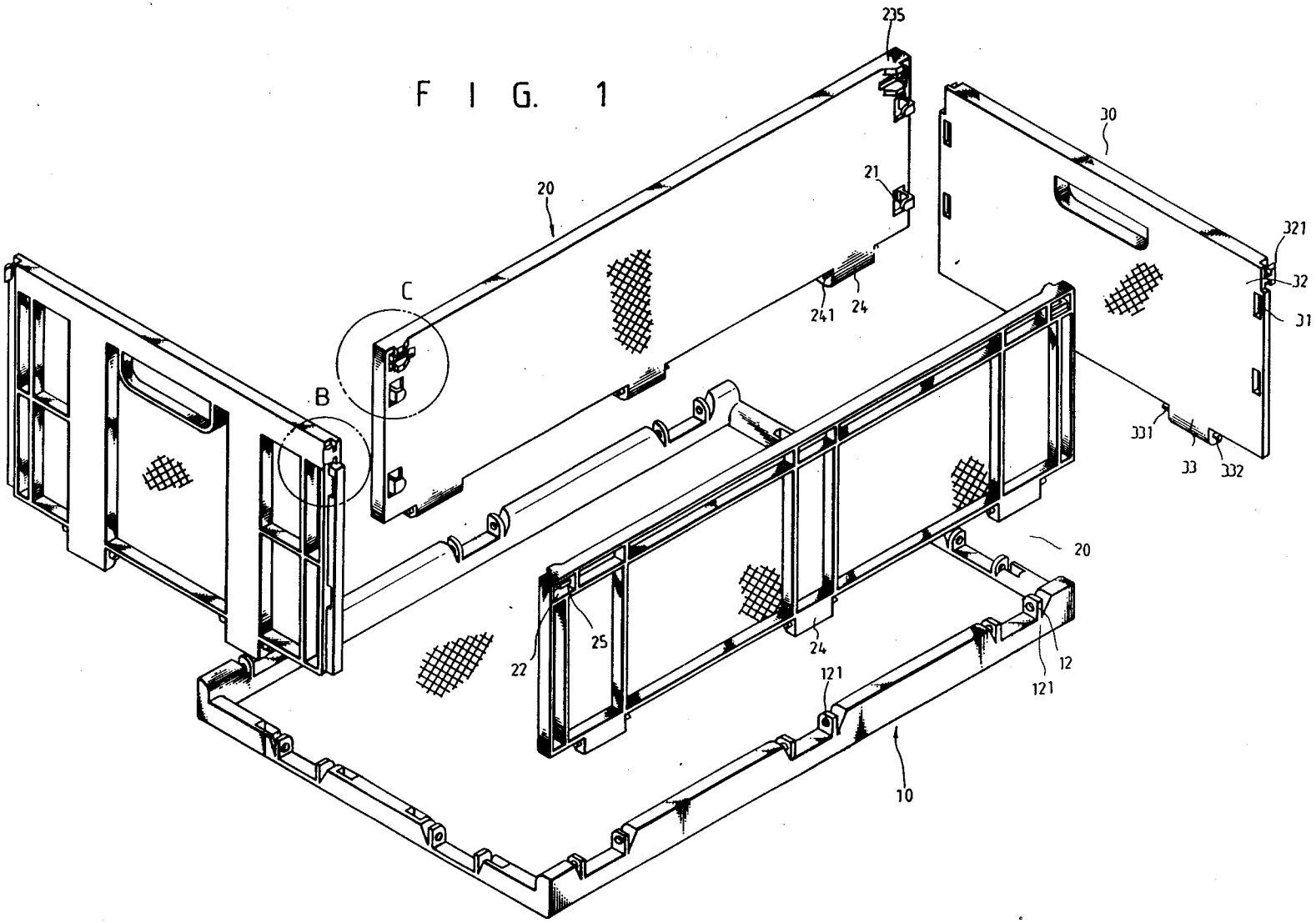
FIG. 1 is a perspective exploded diagram of the preferred embodiment of the present invention.

Please refer to FIG. 1, the present invention provides an improved box crate container which has a base plate 10, a pair of side plates 20 and a pair of handle plates 30. Base plate 10 is a rectangularly shaped single piece plastic injection molded part. A plurality of swivel recesses 11, are formed at fixed location on the periphery of base plate 10. On both sides of each swivel recesses 11 are formed parallel pivot tabs 12. On the far side of each tab 12 is enough open space to allow elastic bending of pivot tabs 12. A pivot hole 121 is set on each pivot tabs 12. Side plate 20 and handle plate 30 are respectively single piece plastic injection molded, are connected with base plate 10 on their lower sides. Close to the edge of handle plate 30, on the inner side of side plate 20 are formed several "L" shaped protruding catches 21. On the top of each side plate 20, over protruding catches 21 is formed a "T" shaped slot 22.

Figure 5:
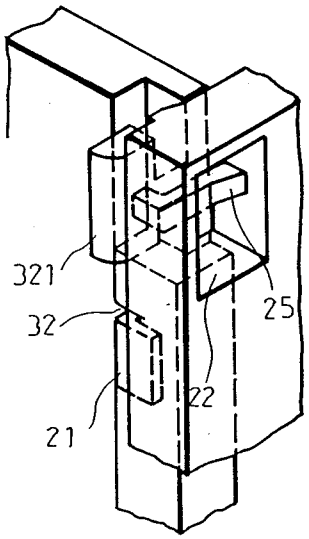
FIG. 5 is a projection diagram of FIG. 4.
Figure 6:
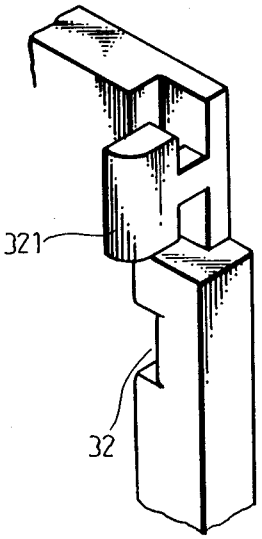
FIG. 6 is a perspective close-up diagram of the section B of FIG. 1.
Figure 7:
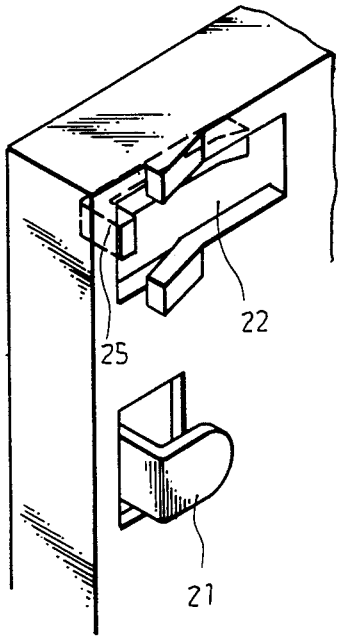
FIG. 7 is a perspective close-up diagram of the section C of FIG. 1.

Please refer to 4, 6 and 7 section of "T" shaped slots 22 that is parallel with the upper edge of side plates 20, acts as a guide 23 for a hook shaped snap-fitting locking tab 32 which is on the top of handle plate 30 to perpendicularly snap fit into "T" shaped slot 22. An "L" shaped release bar 25 is formed in front of "T" shaped slot 22. Release bar 25 is parallel to "T" shaped slot 22 and also can be penetrated through guide 23 of "T" shaped slot 22 when release bar 25 is pressed. The end of release bar 25 is formed an actuating end 251 is pressed, locking tab 32 is forced to bend one way to release the lock, thus the improved box crate container will be easily folded. FIG. 5 here is only for clearly showing where guide 23 is. Since it is hard to tell the location of guide 23, if we just refer to figures which is only taken from the perspective viewpoint.

As shown in FIG. 1, on the lower side of side plates 20 and handle plates 30, corresponding to swivel recesses 11 of base plate 10, are formed a plurality of connecting blocks 24 and 33. Corresponding to pivot holes 121 of pivot tabs 12 which are located on both sides of each recess 11, a pair of snap-fitting pivot axes 241 and 331 are formed on either side of connecting blocks 24 and 33. For connecting with protruding catches 21, beneath locking tab 32, a plurality of rectangular slots 31 are formed on the periphery of handle plates 30.

OPERATION OF THE PRESENT INVENTION

Figure 2:
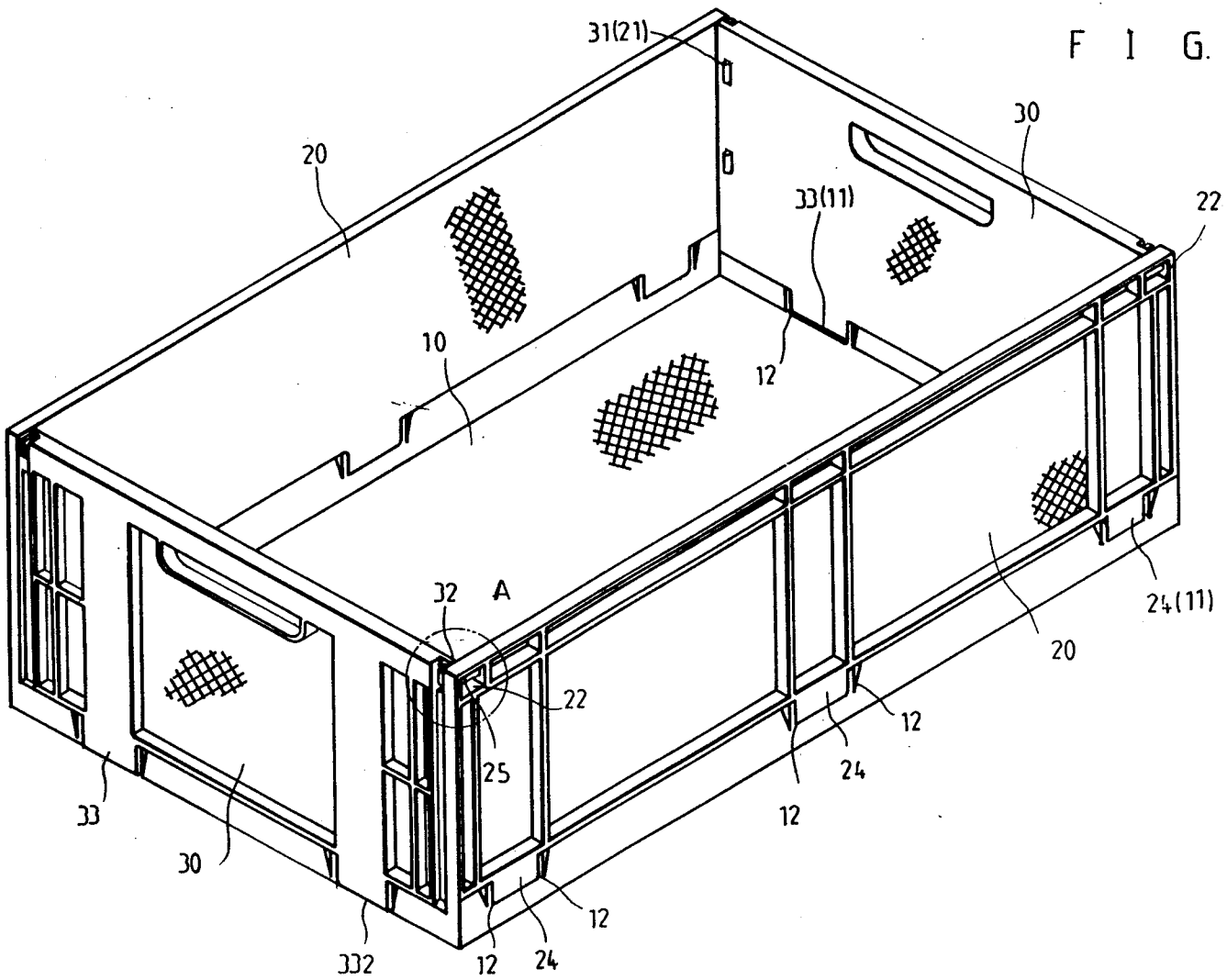
FIG. 2 is a perspective diagram of the preferred embodiment in assembled form.
Figure 3:
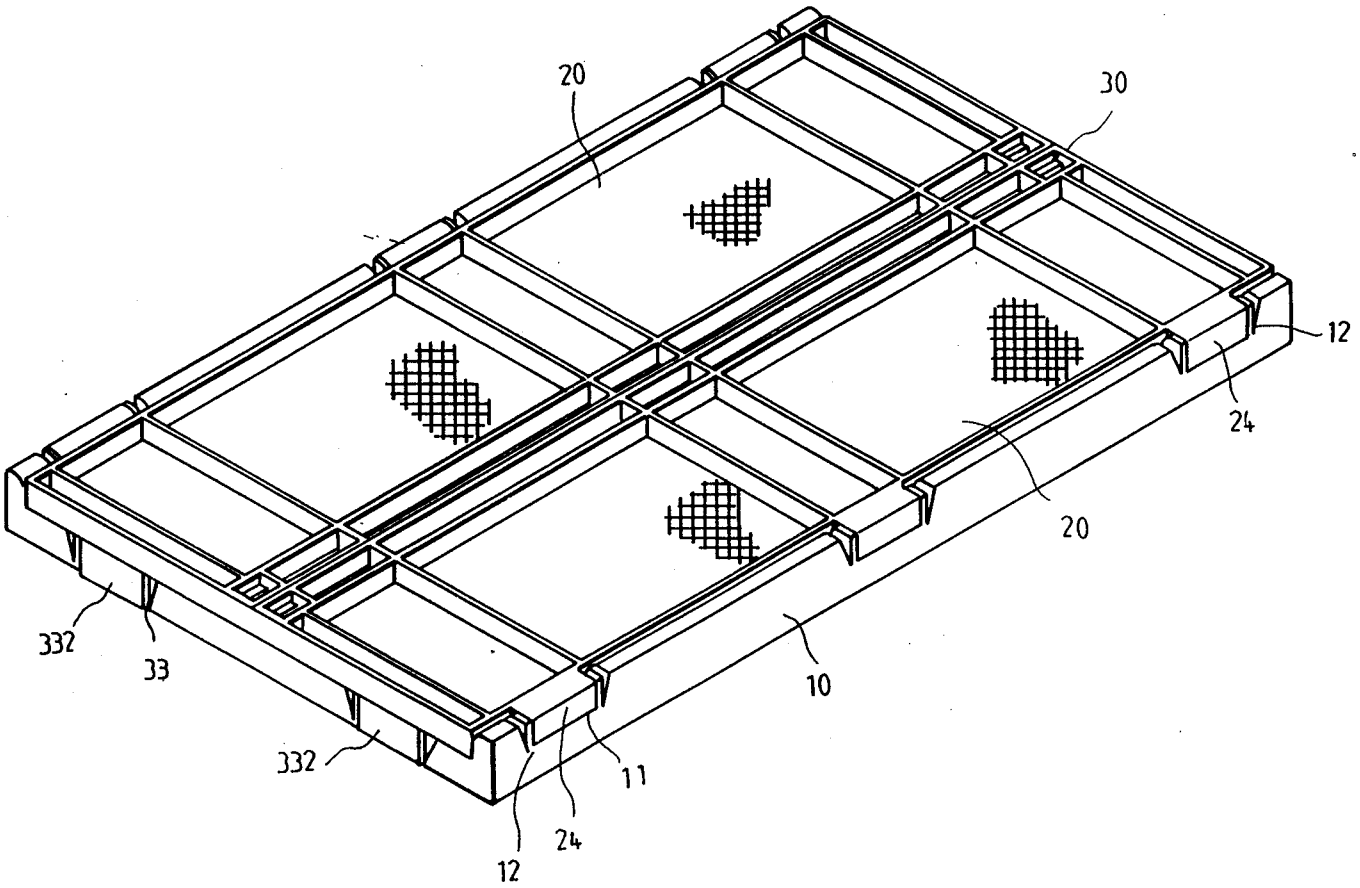
FIG. 3 is a perspective diagram of the preferred embodiment in folded form.
Figure 4:
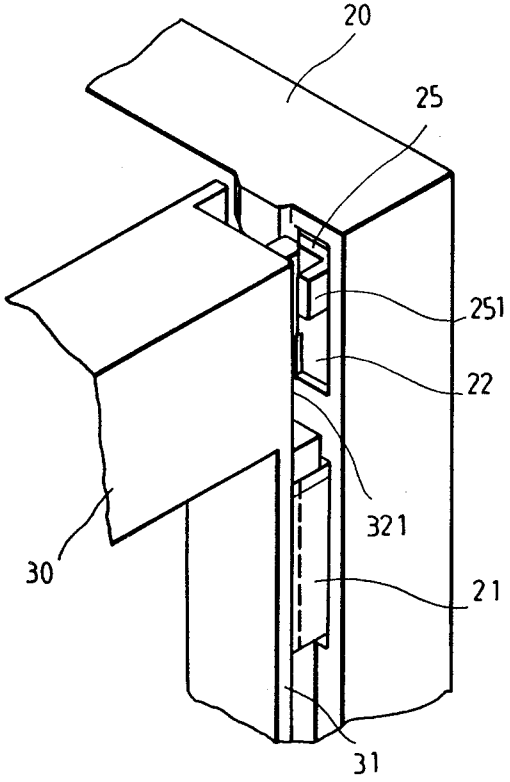
FIG. 4 is a perspective close-up diagram of the section A of FIG. 2.

First, with swivel recesses 11 up, base plate 10 is placed on the floor, then take handle plates 30, adjust connecting blocks 33 over swivel recesses 11 and press down. By this action, snap-fitting pivot axes 331 will be snapped fit into pivot holes 121 of pivot tabs 12, and thus, handle plates 30 are connected with base plate 10. Connect side plates 20 and base plate 10 with the same action as the above mentioned. So now, the improved box crate container will be completed as shown in FIG. 3. When the improved box crate container is used, pull handle plates 30 to the opposite direction until locking tabs 32 snap fit into "T" shaped slots 22 through guide 23. Of course, protruding catches 21 will snap fit into rectangular slots 31 at the same time. Therefore, the improved box crate container would then be easily unfolded as shown in FIG. 2. The improved box crate container could be easily folded by pressing release bars 25. When the release bars 25 are pressed, the actuating ends 251 of release bars would be forced to bend locking tabs one way to release the lock, so the improved box crate container would be folded again.

A TABLE OF FIGURE DESCRIPTION
(only for reference)

| | |
|---|---|
| 10 = base plate | 11 = swivel recess |
| 12 = pivot tab | 121 = pivot hole |
| 20 = side plate | 21 = protruding catch |
| 22 = "T" shaped slot (also FIG. 1A & 1C) | 23 = guide(also FIG. 1A & 1C) |
| 24 = connecting block | 241 = snap fitting pivot axes |
| 25 = release bar (only in FIG. 1A, 1A' & 1B) | |
| 251 = actuating end(only in FIG. 1A, 1A' & 1B; but not in FIG. 1) | |
| 30 = handle plate | 31 = rectangular slot |
| 32 = "T" shaped snap-fitting locking tab (also in FIG. 1C) | |
| 33 = connecting block | |
| 331 = snap-fitting pivot axes | |

I claim:

1. An improved box crate container, comprising: a base plate, a pair of side plates and a pair of handle plates;

said base plate on which periphery is formed a plurality of swivel recesses, on either side of each said swivel recess is formed a pair of pivot tabs, a pivot hole which is formed on each said pivot tab;

each said side plate which has two "T" shaped slots formed respectively on the upper corners of the inner surface, each section of said "T" shaped slots that is parallel with the upper edge of said side plates is formed a guide, an "L" shaped release bar formed within each said "T" shaped slot and parallel to said guide, on the end of said release bar is formed an actuating end, a plurality of "L" shaped protruding catches formed on the inner peripheral surface under each said "T" shaped slot, a plurality of connecting blocks formed on the lower portion, each said connecting block which has a pair of snap-fitting pivot axes formed on either side; said side plates are connected with said base plate by pressing downward and passing said snap-fitting pivot axes through said pivot holes;

each said handle plate which has two hook shaped snap-fitting locking tabs formed respectively on the upper corners and connected with said "T" shaped slots of said side plates, a plurality of rectangular slots formed on the inner peripheral surface which is corresponding and adjacent to said "L" shaped protruding catches, a plurality of connecting blocks formed on the lower portion, each said connecting block which has a pair of snap-fitting pivot axes formed on either side; said handle plates are connected with said base plate by pressing downward and passing said snap-fitting pivot axes through said pivot holes; said rectangular slots of said handle plates are connected with said "L" shaped protruding catches of said side plates by pivoting upward; said container is collapsible when said actuating end of said release bar is pressed to bend said hook shaped snap-fitting locking tab one way to release the interlock of said side and handle plates.

* * * * *